US006623256B2

(12) United States Patent
Takagi et al.

(10) Patent No.: US 6,623,256 B2
(45) Date of Patent: Sep. 23, 2003

(54) PUMP WITH INERTANCE VALUE OF THE ENTRANCE PASSAGE BEING SMALLER THAN AN INERTANCE VALUE OF THE EXIT PASSAGE

(75) Inventors: Kunihiko Takagi, Okaya (JP); Takeshi Seto, Chofu (JP); Kazuhiro Yoshida, Yamato (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/995,621

(22) Filed: Nov. 29, 2001

(65) Prior Publication Data

US 2002/0114716 A1 Aug. 22, 2002

(30) Foreign Application Priority Data

Feb. 21, 2001 (JP) ..... 2001-045359

(51) Int. Cl.[7] ..... F04B 17/00

(52) U.S. Cl. ..... 417/413.2; 417/413.1; 417/542; 417/557; 417/521

(58) Field of Search ..... 417/413.2, 413.1, 417/542, 557, 521

(56) References Cited

U.S. PATENT DOCUMENTS

| | | | | |
|---|---|---|---|---|
| 3,125,033 A | | 3/1964 | Marye | 103/150 |
| 3,216,365 A | * | 11/1965 | Dettinger et al. | 417/521 |
| 3,950,761 A | * | 4/1976 | Kashio | 347/85 |
| 4,407,330 A | | 10/1983 | Fujiwara | 138/30 |
| 5,096,394 A | * | 3/1992 | Gerlach et al. | 417/500 |
| 5,215,446 A | | 6/1993 | Takahashi et al. | 417/332 |
| 5,338,164 A | | 8/1994 | Sutton et al. | 417/4 B |

FOREIGN PATENT DOCUMENTS

| | | |
|---|---|---|
| EP | 0 610 569 A1 | 8/1994 |
| JP | A 8-506874 | 7/1996 |
| JP | A 8-312537 | 11/1996 |
| JP | A 10-220357 | 8/1998 |
| JP | A 2000-265964 | 9/2000 |
| JP | A 2000-274374 | 10/2000 |
| WO | WO 94/19609 | 9/1994 |
| WO | WO 99/20898 | 4/1999 |

* cited by examiner

*Primary Examiner*—Charles G. Freay
*Assistant Examiner*—Emmanuel Sayoc
(74) *Attorney, Agent, or Firm*—Oliff & Berridge, PLC

(57) ABSTRACT

Since many valves are used, pressure loss is large, resulting in low reliability of a pump. Even when the period of increasing and decreasing the volume of a pump chamber is long, and a piezoelectric element is used as an actuator that drives a diaphragm, a driving operation cannot be performed at a high frequency, or a proper flow rate cannot be realized under a high load pressure. In accordance with the invention, the combined inertance value of an entrance passage used to make working fluid flow into a pump chamber is smaller than the combined inertance value of an exit passage used to make the working fluid flow out from the pump chamber. A fluid resistance member is provided at the entrance passage in which fluid resistance when the working fluid flows into the pump chamber is smaller than fluid resistance when the working fluid flows out of the pump chamber.

18 Claims, 5 Drawing Sheets

PUMP WITH INERTANCE VALUE OF THE ENTRANCE PASSAGE BEING SMALLER THAN AN INERTANCE VALUE OF THE EXIT PASSAGE

BACKGROUND OF THE INVENTION

1. Field of Invention

The present invention relates to a pump that moves a fluid by changing the volume of the inside of a pump chamber using, for example, a piston or a diaphragm.

2. Description of Related Art

A conventional example of such a type of pump typically has a structure that is similar to the structure disclosed in Japanese Unexamined Patent Application Publication No. 10-220357 including a check valve that is mounted between an entrance passage and an exit passage, and a pump chamber defining a volume can be changed.

An example of a structure of a pump that produces a flow in one direction by making use of the viscosity resistance of a fluid is disclosed in Japanese Unexamined Patent Application Publication No. 8-312537. In this Publication, a valve is provided at an exit passage, and the fluid resistance at an entrance passage is greater than the fluid resistance at the exit passage when opening the valve.

An example of a structure of a pump that is made to be more reliable without using a movable part at a valve is disclosed in Published Japanese Translations of PCT International Publication for Patent Application No. 8-506874. This Publication discloses a compression structural member in which an entrance passage and an exit passage have shapes that are formed so that the pressure drops differ depending on the direction of flow.

However, in the structure disclosed in Japanese Unexamined Patent Application Publication No. 10-220357, both the entrance passage and the exit passage require a check valve, so that there is a problem in that pressure loss is high when a fluid passes through the two check valves. In addition, since fatigue damage may occur due to repeated opening and closing of the check valves, there is another problem in that the larger the number of check valves used, the lower the reliability of the pump.

In the structure disclosed in Japanese Unexamined Patent Application Publication No. 8-312537, in order to reduce back flow that is produced in the entrance passage during a pump discharge stroke, it is necessary to make the fluid resistance at the entrance passage to be large. When the fluid resistance is made to be large, fluid enters a pump chamber against the fluid resistance during a pump suction stroke, so that the suction stroke takes longer than the discharge stroke. Therefore, the frequency of the discharge-suction cycle of the pump becomes considerably low.

A small, light, high-output pump can be formed by an actuation operation at a high frequency using a piezoelectric element as an actuator for moving a piston or a diaphragm in up and down directions. The piezoelectric element is such that the displacement is small during one period but the response frequency is high, and has the characteristic of providing higher output energy the higher the frequency at which the actuation operation is performed up to the time of resonant frequency of the element. However, in the structure disclosed in Japanese Unexamined Patent Application Publication No. 8-312537, as mentioned above, an actuation operation can only be performed at a low frequency, so that there is a problem in that a pump that makes full use of the features of the piezoelectric element cannot be realized.

In the structure disclosed in Published Japanese Translations of PCT International Publication for Patent Application No. 8-506874, in accordance with an increase or a decrease in the volume of the pump chamber, the net quantity of flow is caused to be in one direction due to differences in pressure drops depending on the direction of flow of the fluid that passes through the compression structural member. Therefore, the back flow rate increases as external pressure (load pressure) at the exit side of the pump increases, resulting in the problem that the pump no longer operates at high load pressure. According to the treatise entitled "An Improved Valve-less Pump Fabricated Using Deep Reactive Ion Etching" presented in 1996 IEEE $9^{th}$ International Workshop on Micro Electro Mechanical Systems, the maximum load pressure is of the order of 0.76 atmospheres.

SUMMARY OF THE INVENTION

Accordingly, it is an object of the present invention to provide a small, light and high-output pump which can operate under high load pressure, which makes it possible to reduce pressure loss and to increase its reliability by decreasing the number of mechanical on-off valves used, and which makes full use of the features of a piezoelectric element when the piezoelectric element is used as an actuator that actuates a piston or a diaphragm as a result of reducing the period of increasing and decreasing the volume of a pump chamber.

In order to overcome the above-described problems, according to a first aspect of the invention, a pump is provided that includes a pump chamber whose volume is changeable by a member including a piston and a diaphragm, an entrance passage used to make working fluid flow into the pump chamber, and an exit passage used to make the working fluid flow out from the pump chamber. A combined inertance value of the entrance passage is smaller than a combined inertance value of the exit passage. The entrance passage is provided with a fluid resistance member in which fluid resistance when the working fluid flows into the pump chamber is smaller than fluid resistance when the working fluid flows out of the pump chamber.

An inertance value L is determined by the expression $L=\rho 1/S$, wherein the cross-sectional area of a flow path is S, the length of a flow path is 1, and the density of the working fluid is $\rho$. When a passage pressure difference is P, and the flow rate in a passage is Q, and when the inertance L is used to transform the formula of the movement of a fluid inside a passage, the relationship $P=L\times dQ/dt$ is derived. In other words, the inertance value indicates the degree of influence that unit pressure has on the change in the flow rate per second. The larger the inertance value, the smaller the change in the flow rate per second, whereas the smaller the inertance value, the larger the change in the flow rate per second.

The combined inertance value for parallel connection of a plurality of passages and for series connection of a plurality of passages having different shapes is calculated by combining the inertance values of the individual passages similarly to the way the inductance values for parallel connection and those for series connection in electrical circuits are combined.

Here, the entrance passage refers to a passage that extends from the inside of the pump chamber to a fluid flow-in-side end surface of an entrance connecting tube that connects the pump to the outside. However, when a pulsation absorbing device, such as that described below, is connected, the entrance passage refers to a passage that extends from the inside of the pump chamber to a connection portion with the pulsation absorbing device. Further, when the entrance passages of a plurality of pumps merge as described below, it refers to a passage from the inside of the pump chamber to the merging portion.

In accordance with the operation of the pump having the structure such as that described above with regard to the first aspect of the invention, when the piston or the diaphragm operates in the direction in which the volume of the pump chamber becomes small, this direction is, at the entrance passage, the direction in which the fluid flows out, so that the fluid resistance of the fluid resistance member is large, thereby making the fluid flowing out from the entrance passage very small or zero. On the other hand, at the exit passage, when the pressure inside the pump chamber increases in accordance with the shrinkage ratio of the fluid, the flow rate in the direction in which the fluid flows out from the pump chamber increases in accordance with the difference between the pressure inside the chamber and the load pressure and the inertance value.

When the piston or the diaphragm operates in the direction in which the volume of the pump chamber increases, the pressure inside the pump chamber decreases. When the pressure inside the pump chamber becomes less than the external pressure of the entrance passage, this direction is, at the entrance passage, the direction in which the fluid flows in, so that the fluid resistance of the fluid resistance member becomes small, thereby causing an increase in the flow rate in the direction in which the fluid flows into the pump chamber in accordance with the pressure difference and the inertance value of the entrance passage. On the other hand, in the exit passage, in accordance with the difference between the load pressure and the pressure inside the pump chamber, and the inertance value, the flow rate in the direction in which the fluid flows out from the pump chamber is reduced.

Here, at the entrance passage, the greater the rate of increase of the flow rate of the fluid that flows in, fluid of an amount corresponding to the volume that has flown out from the inside of the pump chamber can be made to flow into the pump chamber while the amount of decrease in the flow rate of the fluid that flows out at the exit passage is small. Therefore, in the present invention, the combined inertance value of the entrance passage is made to be smaller than the combined inertance value of the exit passage.

When this is performed, the number of mechanical on/off valves is reduced, thereby reducing pressure loss and making the pump more reliable. In addition, as described below, since the time required to increase the volume of the pump chamber and the time required to reduce it can be of the same order, an actuator that actuates the piston or the diaphragm can be made to operate at a high frequency. Therefore, when a piezoelectric element is used for the actuator, it is possible to realize a small, light and high-output pump that makes full use of the features of the piezoelectric element.

According to a second aspect of the invention, in the pump of the first aspect, a pulsation absorbing device that absorbs pulsation of the working fluid is connected to a working fluid entrance side of the entrance passage. When this is performed, since pressure pulsation caused by the opening and closing of the check valve is restricted, it is possible to restrict the influences of the inertance value of the entrance connecting tube and that caused by an external pipe connected to the entrance connecting tube. In correspondence with the amount by which the influences of the inertance value of the passage inside the entrance connecting tube is restricted, a volume of a flow that is equal to a volume of a flow that has flown out from the exit can flow into the pump chamber in a short time period by the pump of the first embodiment. Therefore, it is possible to cause the period in which the volume of the pump chamber is increased and decreased to be smaller, thereby making it possible to realize a pump that makes full use of the features of a piezoelectric element used as an actuator that actuates a piston or a diaphragm. Further, it is possible to connect a pipe of a freely chosen dimension to the pump without degrading the performance of the pump.

According to a third aspect of the invention, in the pump of the first or second aspects, a plurality of the pump chambers are provided, the entrance passage used to make working fluid flow into the plurality of pump chambers merges at the working fluid entrance side, and the pump further includes a driving device that performs a driving operation by shifting a timing at which volumes of the plurality of pump chambers are changed. By forming this structure, pressure pulsation produced by a change in the fluid resistance of the fluid resistance member is restricted at the entrance connecting tube, disposed upstream from the merging portion, to connect the pump to the outside and at an external pipe portion connected to the entrance connecting tube. Therefore, advantages that are similar to those provided by the structure of the second aspect are provided.

In particular, it is preferable that three pumps be used, and a driving operation be performed by shifting a timing at which the volume of a chamber of each pump is changed by ⅓ period, because the restriction effect is large in contrast with the small number of parts used. It is preferable that this feature be combined with that of the second aspect because the effect of restricting pressure pulsation becomes even greater.

According to a fourth aspect of the invention, in the pump of the third aspect, the exit passage used to make the working fluid flow out from the plurality of pump chambers merges at a working fluid exit side.

When this structure is formed, pressure pulsation produced by a change in the volume of each pump chamber is restricted at an exit connecting tube, disposed downstream from the merging portion, to connect the pump to the outside and at an external pipe portion connected to the exit connecting tube. Therefore, it is possible to connect a pipe of a freely chosen dimension to the exit side of the pump.

According to a fifth aspect of the invention, in the pump recited in any of the first to fourth aspects, a pulsation absorbing device that absorbs pulsation of the working fluid is connected to the working fluid exit side of the exit passage.

When this structure is formed, pressure pulsation produced by a change in the volume of the/each pump chamber is restricted at the exit connecting tube, disposed downstream from the merging portion, to connect the pump to the outside and at an external pipe portion connected to the exit connecting tube. It is preferable to combine this feature with that of the fourth aspect because the effect of restricting pressure pulsation becomes even greater. Therefore, it is possible to connect a pipe of a freely chosen dimension to the exit side of the pump.

According to a sixth aspect of the invention, in the pump of any of the first to fifth aspects, the fluid resistance member is a check valve. Examples of fluid resistance members include those that make use of the nature of a fluid, such as those that are only formed by electrodes and that use working fluid as electroviscous fluid (a fluid whose viscosity increases when a voltage is applied) and a compression structural member disclosed in Published Japanese Translations of PCT International Publication for Patent Application No. 8-506874. However, these fluid resistance members are not very effective in preventing a fluid inside a pump chamber from flowing out to the outside through an entrance passage when the pressure inside the pump chamber becomes high. In other words, these fluid resistance members do not have much checking effect. Therefore, it is preferable to use a check valve that prevents back flow as the fluid resistance member.

When this structure is formed, the piston or the diaphragm operates in a direction in which the volume of the pump chamber/each pump chamber becomes small, so that back flow at the entrance passage when the pressure inside the pump chamber/each pump chamber becomes high is prevented from being produced. Therefore, it is possible to sufficiently increase the pressure inside the pump chamber/each pump chamber, so that, even when the load pressure is high, the working fluid can be sent towards the load side. In addition, the load pressure can be maintained when the pump is stopped.

According to a seventh aspect of the invention, in the pump of the second to fifth aspects, the pulsation absorbing device includes a resilient wall chamber which has at least a portion thereof formed by a resilient wall, and whose amount of change in volume per unit pressure is greater than the working fluid. When this structure is formed, it is possible to form the pulsation absorbing device by a relatively simple method.

According to an eighth aspect of the invention, in the pump of any of the first to seventh aspects, the working fluid entrance side of the entrance passage and a working fluid entrance side of the exit passage are chamfered or rounded. When this structure is formed, since the fluid resistance at each fluid path is reduced, it is possible to increase the performance of the pump.

The working fluid entrance side refers to the side towards which the fluid flows in when the fluid is made to flow in the forward direction (load direction) as a result of operating the pump. The working fluid exit side is the side towards which the fluid flows out when the fluid is made to flow in the forward direction as a result of operating the pump.

DETAILED DESCRIPTION OF PREFERRED EMBODIMENTS

Hereunder, a description of a plurality of embodiments of the present invention will be provided based on the drawings.

Figure 1:
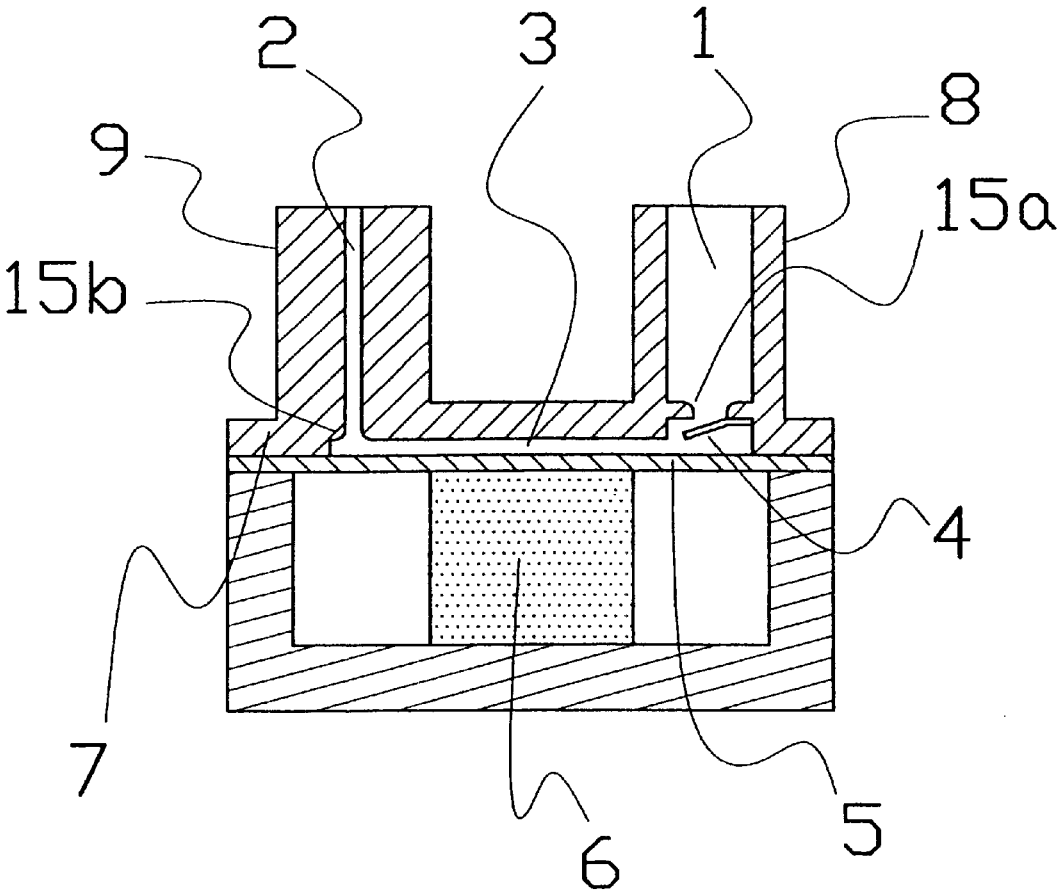
FIG. 1 is a vertical sectional view of a first embodiment of a pump in accordance with the present invention.

First, a description of a first embodiment of a pump in accordance with the present invention will be provided with reference to FIG. 1. FIG. 1 is a vertical sectional view of a pump of the present invention. A circular diaphragm 5 is placed at the bottom portion of a cylindrical case 7. The outer peripheral edge of the diaphragm 5 is secured to and supported by a case 7 so that it is freely resiliently deformed. A piezoelectric element 6 that expands and contracts in the vertical direction in the figure is disposed as an actuator that moves the diaphragm 5 at the bottom surface of the diaphragm 5.

A narrow space between the diaphragm 5 and the top wall of the case 7 is a pump chamber 3, with an exit passage 2 and an entrance passage 1, at which a check valve 4 serving as a fluid resistance member is provided, opening towards the pump chamber 3. A portion of the outer periphery of a component part that forms the entrance passage 1 is formed as an entrance connecting tube 8 that connects an external pipe (not shown) to the pump. A portion of the outer periphery of a component part that forms the exit passage 2 is formed as an exit connecting tube 9 that connects an external pipe (not shown) to the pump. The entrance passage and the exit passage have rounded portions 15*a* and 15*b* that are formed by rounding working fluid entrance sides thereof.

A description will now be provided of the relationship between the symbols of the lengths and areas of the entrance passage 1 and the exit passage 2. In the entrance passage 1, the length and area of a compressed diameter pipe portion near the check valve 4 are represented by L1 and S1, respectively, and the length and area of the remaining enlarged pipe portion are represented by L2 and S2, respectively. In the exit passage 2, the length and area of a pipe portion thereof are represented by L3 and S3, respectively.

Using these symbols and density ρ of the working fluid, the relationship between the inertance values of the entrance passage 1 and the exit passage 2 will be described.

The combined inertance value of the entrance passage 1 is calculated by the formula $\rho\times(L1/S1+L2/S2)$. On the other hand, the combined intertance value of the exit passage 2 is calculated by the formula $\rho\times L3/S3$ because the exit passage 2 consists of only one passage. These flow paths have a dimensional relationship that satisfies the condition $\rho\times(L1/S1+L2/S2)<\rho\times L3/S3$.

A description of the operation of the pump of the present invention will now be provided.

By applying AC voltage to the piezoelectric element 6, the diaphragm 5 vibrates in order to successively change the volume of the pump chamber 3.

Figure 2:
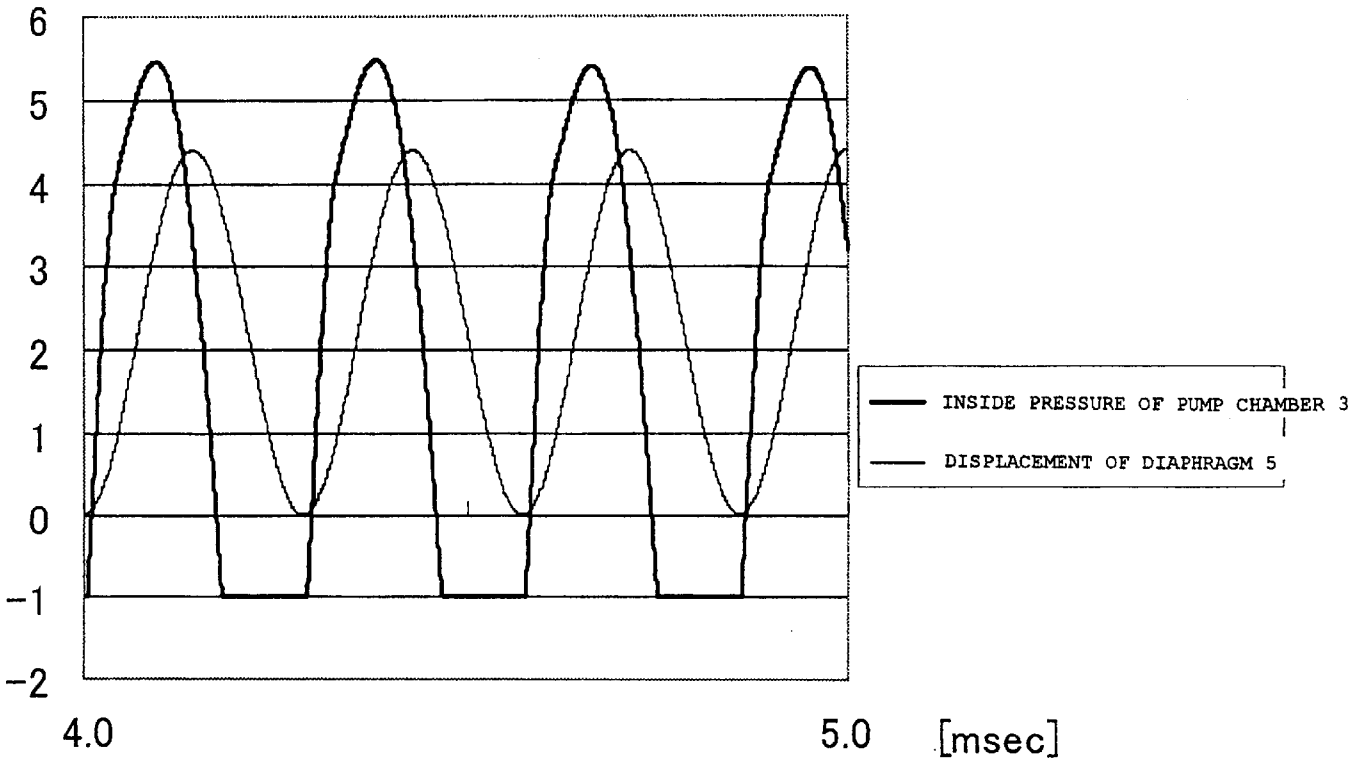
FIG. 2 is a graph that illustrates the waveform of the displacement of a diaphragm and the waveform of the inside pressure of a pump chamber of the pump of the first embodiment of the present invention.

FIG. 2 shows the waveform of the inside pressure (in atmospheres at gauge pressure) of the pump chamber 3 and the waveform of the displacement (in microns) of the diaphragm 5 when the pump operates under load pressure of 1.5 atmospheres at gauge pressure and the discharge rate is large. In the diaphragm displacement waveform, the area where the tilting of the waveform is positive corresponds to the stage in which the volume of the pump chamber 3 is decreasing as a result of expansion of the piezoelectric element 6. On the other hand, the area where the tilting of the waveform is negative corresponds to the stage in which the volume of the pump chamber 3 is increasing as a result of compression of the piezoelectric element 6. When the stage in which the volume of the pump chamber 3 decreases starts, the inside pressure of the pump chamber 3 starts to rise. Then, due to a reason mentioned later, prior to completion of the volume decreasing process, the pressure reaches a maximum value, and then starts to decrease. In addition, when the stage in which the volume of the pump chamber 3 increases starts, the pressure successively decreases, so that during the stage in which the volume increases, a vacuous state is produced inside the pump chamber, thereby causing the pressure to be a constant value of zero atmospheres at absolute pressure that is equal to the pressure of −1 atmospheres at gauge pressure.

Figure 3:
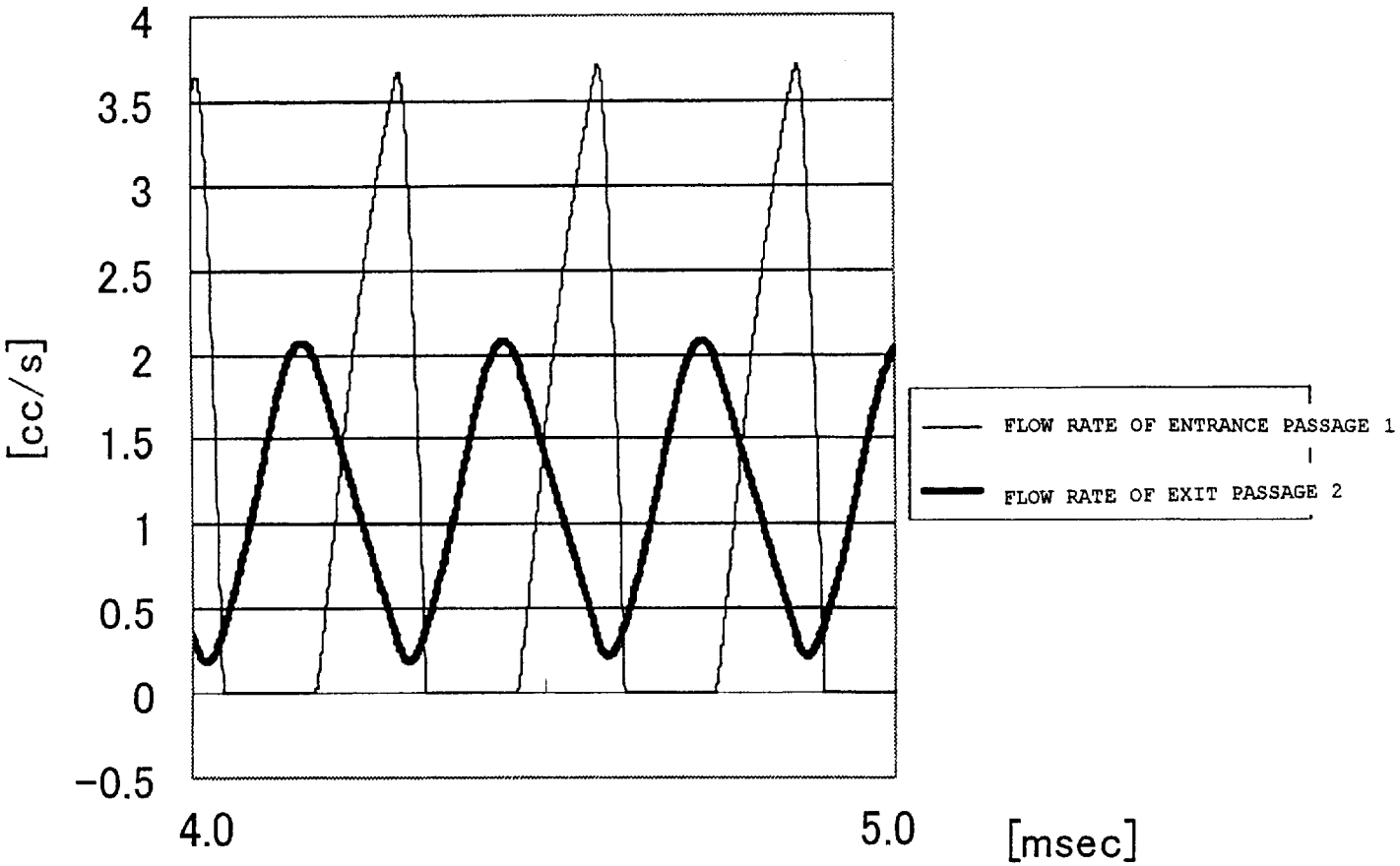
FIG. 3 is a graph that illustrates the waveform of the flow rate at an entrance passage and the waveform of the flow rate at an exit passage of the pump of the first embodiment of the present invention.

FIG. 3 illustrates the waveforms of the flow rates at the entrance passage 1 and the exit passage 2 at this time. In the graph, the flow rates of fluid that flows in the forward direction (load direction) when the pump is operated is defined as the normal direction of flow.

When the inside pressure of the pump chamber 3 rises and becomes greater than the load pressure, the flow rate at the exit passage 2 starts to increase. The fluid inside the pump chamber 3 starts to flow out from the exit passage 2, and, at the point where the flow rate becomes greater than the amount by which the volume of the pump chamber 3 decreases by the displacement of the diaphragm 5, the inside pressure of the pump chamber 3 starts to decrease. When the inside pressure of the pump chamber 3 decreases and becomes less than the load pressure, the flow rate at the exit passage 2 starts to decrease. These rates of changes in the flow rate are equal to the difference between the inside pressure of the pump chamber 3 and the load pressure divided by the inertance value of the exit passage 2. On the other hand, at the entrance passage 1, when the inside pressure of the pump chamber 3 becomes less than atmospheric pressure, this pressure difference causes the check valve 4 to open, so that the flow rate starts to increase. When the inside pressure of the pump chamber 3 increases and becomes greater than atmospheric pressure, the flow rate starts to decrease. As expected, these rates of changes in the flow rate are equal to the difference between the inside pressure of the pump chamber 3 and the atomospheric pressure divided by the inertance value of the entrance passage 1. The checking effect by the check valve 4 prevents back flow.

Here, since the inertance value of the entrance passage 1 is smaller than the inertance value of the exit passage 2, the rate of change in the flow rate at the entrance passage 1 is greater than that at the exit passage 2, so that a volume of a flow that is equal to a volume of a flow that has flown out from the exit passage 2 can flow into the pump chamber 3 in a short period of time. If the inertance value of the entrance passage is greater than the inertance value of the exit passage, back flow is produced in the exit passage because the time required for the fluid to flow in from a suction passage becomes long, so that the discharge rate of the pump is reduced, thereby degrading the performance of the pump.

As described above, in the pump of the present invention, a valve only needs to be disposed at the entrance passage, thereby making it possible to reduce pressure loss at the valve and to increase the reliability of the pump. In addition, as will be mentioned below, the time required to increase the volume of the pump chamber and the time required to decrease the volume of the pump chamber are of the same order, so that the actuator that actuates the piston or the diaphragm can operate at a high frequency. Therefore, it is possible to realize a small, light and high-output pump that makes full use of the features of a piezoelectric element. In addition, it is possible for the pump to operate under a high load pressure.

Figure 4:
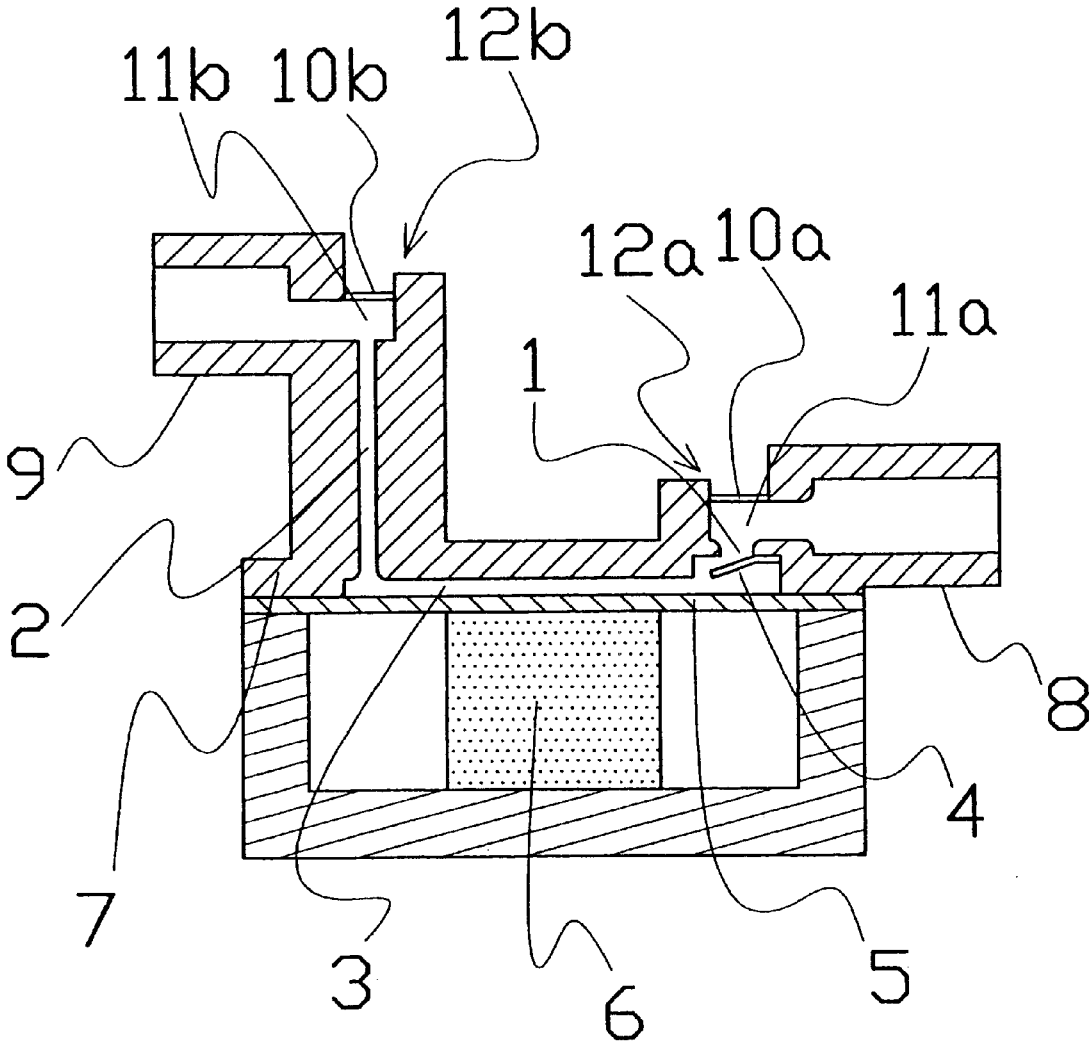
FIG. 4 is a vertical cross section of a second embodiment of a pump of the present invention.

Next, a description of a second embodiment of a pump in accordance with the invention will be provided with reference to FIG. 4.

FIG. 4 is a vertical sectional view of a pump of the present invention. In the embodiment, a pulsation absorbing device 12*a*, including a resilient wall chamber 11*a* having a resilient wall 10*a* disposed at the top side thereof, is mounted to a working fluid entrance side of an entrance passage 1 that is a compressed diameter portion disposed near a check valve 4. A portion of a wall surface of the resilient wall chamber 11*a* is connected to an entrance connecting tube 8 to connect an external pipe (not shown) to the pump. A pulsation absorbing device 12*b*, including a resilient wall chamber 11*b* having a resilient wall 10*b* disposed at the top side thereof, is mounted to a working fluid exit side of an exit passage 2. A portion of a wall surface of the resilient wall chamber 11*b* is connected to an exit connecting tube 9 to connect an external pipe (not shown) to the pump.

When the amount of change in volume per unit volume of each of the resilient wall chambers 11*a* and 11*b* is such as to be greater than the working fluid, for the resilient walls 10*a* and 10*b*, any material that is resilient, such as plastic, rubber, or a metallic thin plate, may be used. The resilient walls 10*a* and 10*b* may be realized by securing parts that are formed separately of the other wall surfaces of the resilient wall chambers 11*a* and 11*b*, or by forming portions of wall surfaces of the resilient chambers thin in order to form integral structures. The resilient wall chambers 11*a* and 11*b* are connected so that the combined inertance value of the entrance passage 1 is smaller than the combined inertance value of the exit passage 2.

When this is performed, since pressure pulsation caused by the opening and closing of the check valve 4 is restricted, it is possible to restrict the influences of the inertance value of the entrance connecting tube 8 and that caused by an external pipe (not shown) connected to the entrance connecting tube 8. In correspondence with the amount by which the influences of the inertance value of the passage inside the entrance connecting tube 8 is restricted, a volume of a flow that is equal to a volume of a flow that has flown out from the exit passage 2 can flow into the pump chamber 3 in a short time period by the pump of the first embodiment. Therefore, it is possible to cause the period in which the volume of the pump chamber is increased and decreased to be smaller, thereby making it possible to realize a pump that makes full use of the features of a piezoelectric element used as an actuator that actuates a piston or a diaphragm. Further, it is possible to connect a pipe of a freely chosen dimension to the pump without degrading the performance of the pump.

Figure 5:
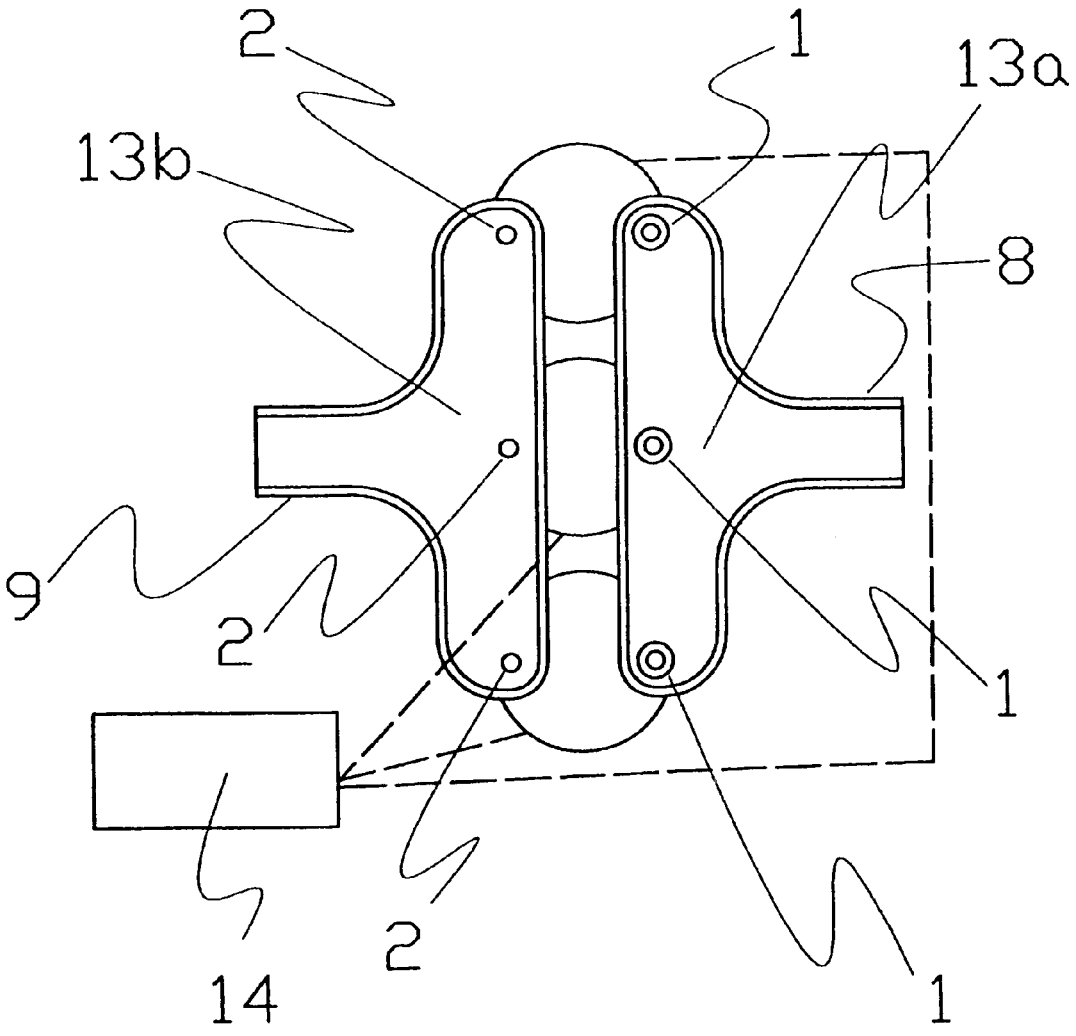
FIG. 5 is a plan view of a third embodiment of a pump of the present invention.

Next, a description of a third embodiment of a pump of the present invention will be provided with reference to FIG. 5.

FIG. 5 illustrates the third embodiment of the pump as viewed from the top surface thereof, in which the portion from an entrance connecting tube 8 to each entrance passage 1, and a portion from an exit connecting tube 9 to each exit passage 2 are shown in cross section. In the embodiment, three pumps of the first embodiment type are used. A merging portion 13*a* is formed between the entrance connecting tube 8 and each entrance passage 1, and a merging portion 13*b* is formed between the exit connecting tube 9 and each exit passage 2, so that the entrance passage 1 and the exit path 2 of each pump merge. The broken lines shown in FIG. 5 represent the driving device 14 that performs a driving operation by shifting a timing at which the volume of a chamber of each pump changes by ⅓ period is connected to each pump. Here, a portion of a wall surface of each of the merging portions 13*a* and 13*b* may be a resilient wall surface.

When this is performed, since pressure pulsation caused by the opening and closing of the check valve 4 is restricted, it is possible to restrict the influences of the inertance value of the entrance connecting tube 8 and that caused by an external pipe (not shown) connected to the entrance connecting tube 8. In correspondence with the amount by which the influences of the inertance value of the passage inside the entrance connecting tube 8 is restricted, a volume of a flow that is equal to a volume of a flow that has flown out from the exit passage 2 can flow into the pump chamber 3 in a short time period by the pump of the first embodiment. Therefore, it is possible to cause the period in which the volume of each pump is increased and decreased to be smaller, thereby making it possible to realize a pump that makes full use of the features of a piezoelectric element used as an actuator that actuates a piston or a diaphragm. Further, it is possible to connect a pipe of a freely chosen dimension to each pump without degrading the performance of the pump.

Pressure pulsation that occurs due to changes in the volume of each pump chamber is restricted at the exit connecting tube, disposed downstream from the merging portion, to connect each pump to the outside and at an external pipe connected to the exit connecting tube. Therefore, it is also possible to connect a pipe of a freely chosen dimension to the exit side of each pump.

In the above-described embodiments, the diaphragm used is not limited to a circular diaphragm. In addition, the actuator that moves a diaphragm is not limited to a piezoelectric element, so that any other actuator may be used as long as it expands and contracts. Further, the check valve used is not limited to that which opens and closes due to a pressure difference of a fluid, so that other types of check valves that can control the opening and closing thereof by a force other than that produced by a pressure difference of a fluid may be used.

As can be understood from the foregoing description, according to the aspects of the invention, since a fluid resistance member, such as a valve, needs to be disposed only at the entrance passage, pressure loss at the fluid resistance member can be reduced, and the pump can be made more reliable. In addition, since the time required to increase the volume of a pump chamber and the time required to reduce the volume of the pump chamber can be of the same order, an actuator that actuates a piston or a diaphragm can operate at a high frequency. Therefore, a small, light and high-output pump that makes full use of the features of a piezoelectric element can be realized. In addition, a pump that operates under high load pressure can be realized.

What is claimed is:

1. A pump for use with a working fluid, comprising:

a member including a piston and a diaphragm;

a pump chamber whose volume is changeable by the member;

an entrance passage through which the working fluid flows into the pump chamber;

an exit passage through which the working fluid flows out from the pump chamber, a combined inertance value of the entrance passage being smaller than a combined inertance value of the exit passage; and a fluid resistance member provided at the entrance passage such that fluid resistance when the working fluid flows into the pump chamber is smaller than fluid resistance when the working fluid flows out of the pump chamber, wherein the member including the piston and the diaphragm is driven so that the pressure in the pump chamber is decreased to zero atmospheres in absolute pressure.

2. The pump according to claim 1, further including a pulsation absorbing device that absorbs pulsation of the working fluid, the pulsation absorbing device being connected to a working fluid entrance side of the entrance passage.

3. The pump according to claim 1, further including a plurality of the pump chambers, the entrance passage usable to make working fluid flow into the plurality of pump chambers merges at a working fluid entrance side, and a driving device that performs a driving operation by shifting a timing at which volumes of the plurality of pump chambers are changed.

4. The pump according to claim 3, the exit passage usable to make the working fluid flow out from the plurality of pump chambers merging at a working fluid exit side.

5. The pump according to claim 1, further including a pulsation absorbing device that absorbs pulsation of the working fluid is connected to a working fluid exit side of the exit passage.

6. The pump according to claim 1, the fluid resistance member being a check valve.

7. The pump according to claim 2, the pulsation absorbing device including a resilient wall chamber which has at least a portion thereof formed by a resilient wall, and having an amount of change in volume per unit pressure that is greater than the working fluid.

8. The pump according to claim 1, an entrance side of the entrance passage having at least one protrusion forming a throat, the protrusion being at least one of chamfered and rounded.

9. The pump according to claim 2, further including a plurality of the pump chambers, the entrance passage usable to make working fluid flow into the plurality of pump chambers merges at a working fluid entrance side, and a driving device that performs a driving operation by shifting a timing at which volumes of the plurality of pump chambers are changed.

10. The pump according to claim 9, the fluid resistance member being a check valve.

11. The pump according to claim 2, further including a pulsation absorbing device that absorbs pulsation of the working fluid is connected to a working fluid exit side of the exit passage.

12. The pump according to claim 11, the fluid resistance member being a check valve.

13. The pump according to claim 2, the fluid resistance member being a check valve.

14. The pump according to claim 3, further including a pulsation absorbing device that absorbs pulsation of the working fluid is connected to a working fluid exit side of the exit passage.

15. The pump according to claim 14, the fluid resistance member being a check valve.

16. The pump according to claim 3, the fluid resistance member being a check valve.

17. The pump according to claim 1, wherein the exit passage has an entrance side that forms an axial cross-section that is at least one of chamfered and rounded.

18. The pump according to claim 1, wherein the piston is actuated by a piezoelectric element.

* * * * *